US007179105B1

(12) United States Patent
Hung

(10) Patent No.: US 7,179,105 B1
(45) Date of Patent: Feb. 20, 2007

(54) POWER SUPPLY WITH A CHANGEABLE PLUG ELEMENT

(76) Inventor: K. Y. Hung, Room 10-11, 6/F, Kwong Sang Hong Center 151-153 Hoi Bun Road, Kwun Tong, Kowloon, Hong Kong (HK)

( * ) Notice: Subject to any disclaimer, the term of this patent is extended or adjusted under 35 U.S.C. 154(b) by 0 days.

(21) Appl. No.: 11/292,558

(22) Filed: Dec. 2, 2005

(30) Foreign Application Priority Data

Aug. 4, 2005 (CN) ..... 2005 2 0062581 U

(51) Int. Cl.
*H01R 29/00* (2006.01)

(52) U.S. Cl. ..... 439/172; 439/518

(58) Field of Classification Search ..... 439/171–175, 439/518, 956
See application file for complete search history.

(56) References Cited

U.S. PATENT DOCUMENTS 5,613,863 A * 3/1997 Klaus et al. ..... 439/131
5,848,907 A * 12/1998 Chen ..... 439/172
6,109,977 A * 8/2000 Baxter et al. ..... 439/693
6,227,888 B1 * 5/2001 Hahn ..... 439/173
7,008,246 B2 * 3/2006 Zhuge ..... 439/173

* cited by examiner

*Primary Examiner*—Tho D. Ta
(74) *Attorney, Agent, or Firm*—Michael Diaz

(57) ABSTRACT

A power supply with a changeable plug element includes a plug housing and a plug element mounted moveably on the plug housing. The plug housing includes a front cover (1), a circuit board (2), a rear cover (4) and a pair of connecting sheets (5). The rear cover (4) and the front cover (1) engage with each other and contain the circuit board (2). The plug element includes a plug lid (6), a pair of elastic sheets (7) and a base (8) with pins. The plug lid (6) is mounted on the base (8) to form a receiving space, and the elastic sheets (7) are received in the receiving space and connect with pin wires. The plug lid (6) can insert into the plug housing and the connecting sheets (5) may engage with the elastic sheets (7). The present invention has simple structure and low cost and can be operated conveniently.

12 Claims, 8 Drawing Sheets

POWER SUPPLY WITH A CHANGEABLE PLUG ELEMENT

BACKGROUND OF THE INVENTION

1. Field of the Invention

The present invention relates to a power supply, and more especially to a power supply which may change plug elements for matching different specifications of electrical sockets.

2. Description of the Related Art

At present, small, portable power supplies have been applied widely in people's life. Some of them are adapted to provide operational power and some of them serve as charging devices. Although these power supplies have brought people so much convenience, there are many drawbacks when people use these power supplies in different regions, since the shape and structure of electrical sockets in a region vary from those in another region.

Basically, electrical sockets are formed in four types of structure, that is BS socket with three rectangular jacks, UL socket with two tabular jacks, VDE socket with two circular jacks and SAA socket with two tabular jacks being at an angle of 60 degrees to each other. To match various sockets with different structures, people have invented many kinds of power supplies. One such device is disclosed in a Chinese patent with a publication number of CN 2304206Y which describes a traveling power supply with a changeable plug element. As shown in FIG. 1, this power supply forms an opening in its bottom cover and a movable fastener, a positioning slide sheet, a slide base, an internal base and two conduction sheets that are arranged in the opening so as to achieve the function of conduction and plug element conversion. This power supply can replace different types of plug elements in structure. However, when analyzed on the basis of security, there is an obvious hidden danger. For instance, in practice, once a situation of imprecise assembly or improper use occurs, the power plug element 14 is prone to depart from the bottom cover 11. If the power plug element 14 is still being inserted in the socket at this time, users who touch the exposed tab 144 carelessly may easily suffer an electric shock since the exposed tab 144 has the same potential as the power plug element.

A traveling power supply with a changeable plug element is disclosed in the publication number CN 2304206Y. In addition, an adapter with changeable connectors is disclosed in the patent publication number CN 2517145Y and achieves the function of plug element conversion far better and reduces the opportunity for users to contact the tab through setting a slide groove in the external cover. However, this universal adapter also has certain problems. As shown in FIG. 2, to achieve the function of the slide groove, the adapter forms openings in the upper cover and the bottom cover respectively, which make the structure too complicated to assemble. When replacing the plug element, it is only dependent on exerting the horizontal controlling force to push and pull the connector, which can cause unreliable engagement after repetitious operation. Furthermore, the connecter becomes flexible when engage with the covers. Thus, users may be in danger of getting an electric shock when touching the elements within the covers. Additionally, the circuit board is electrically connected with the plug element merely through the contact sheet 331. Because of this tenuous connection, after long-term use, the adapter may provide a poor contact.

Compared with the adapter with changeable connectors in the publication number CN 2517145Y, a multi-function conversion plug element for power supplies disclosed in the patent publication number CN 2361023Y has an improved structure which is more compact and provides for engagement between a connector and the covers in a more reliable manner. As shown in FIG. 3, the plug element only forms a slide groove in a rear cover. Between a pin element and the rear cover is located an elastic fastener 16 and a hook 160 used to fasten the plug element tightly and avoid escape of the plug from the adapter. Although this multi-function conversion plug element for power supplies has an improved structure and engagement mechanism, the poor contact between the circuit board and the pin element still exists after long-term use. In addition, its contact tab is protected by a flute 24. However, if certain conductors such as metal threads drop off into the flute 24, users may be in danger of getting an electric shock when contacting the metal threads.

Thus, it would be a distinct advantage to have a power supply with a changeable plug which is both safe to operate and resilient to continuous use. It is an object of the present invention to provide such an apparatus.

SUMMARY OF THE INVENTION

An object of the present invention is to provide a power supply which may change the plug elements for matching different specification of electrical sockets, to insure reliable contact between a circuit board and pins thereof and secure isolation from its tabs and to ensure the plug element is arranged firmly. The power supply of the present invention is a simple structure and is secure in its operation.

To achieve the above-mentioned object, a power supply with a changeable plug element is disclosed. The power supply with a changeable plug element includes a plug housing and a plug element mounted moveably on the plug housing. The plug housing includes a front cover, a circuit board, a rear cover and a pair of connecting sheets. The rear cover and the front cover engage with each other and contain the circuit board therein. The rear cover forms a slide groove in a bottom surface. The slide groove forms a lock slot in a sidewall. The connecting sheets pass through corresponding through holes arranged in the bottom surface of the rear cover to be mounted on the rear cover. One end of each of the connecting sheets is soldered on the circuit board and the other end is received in the slide groove. There is a gap between the other ends and a bottom surface of the slide groove. The plug element includes a base with pins, a plug lid and a pair of elastic sheets. The plug lid is mounted on the base to form a receiving space. The elastic sheets are received in the receiving space and connected with pin wires. The plug lid inserts into the plug housing along the lock slot and passes through the gap between the connecting sheets and the bottom surface of the slide groove to accommodate the other end of each of the connecting sheets received in the slide groove into the receiving space and to connect the other end with the corresponding elastic sheet.

Advantageously, the plug housing further includes a rear cover lid mounted in the rear cover, the rear cover lid forming a pair of first through holes and a plurality of second through holes, a plurality of projecting posts formed on the rear cover passes through corresponding fourth through holes formed in the connecting sheets to be soldered in the corresponding second through holes of the rear cover lid. The end of each connecting sheet is soldered on the circuit board and passes through the corresponding first through hole and then is soldered on the circuit board.

Advantageously, the rear cover lid forms a guiding slot in a sidewall thereof and the rear cover forms a post on an internal sidewall thereof engaging with the guiding slot.

Advantageously, the connecting sheets insertedly connect with corresponding elastic sheets.

Advantageously, each of the elastic sheets includes a second body. Two guiding sheets are extended from one side of the second body, which form an insert opening therebetween, and the end of each connecting sheet, which is received in the slide groove, is inserted into a corresponding insert opening to connect with the corresponding elastic sheet.

Advantageously, the base includes a pair of first elastic sheet lock slots and a pair of second elastic sheet lock slots therein engaging the second bodies and the guiding sheets of the elastic sheets, respectively.

Advantageously, each of the elastic sheets forms a wire hole through which each of the elastic sheets connects with a corresponding pin wire and a positioning hole through which each of the elastic sheets rivets a pin of a tabular socket.

Advantageously, each of the connecting sheet includes a first body, a first bending arm which bends perpendicularly from one end of the first body, a second bending arm which extends perpendicularly from the other end of the first body towards a reverse direction, and a third bending arm which bends from a free end of the second bending arm and is parallel to the first body. The first bending arm is soldered on the circuit board and the third bending arm connects with the corresponding elastic sheet.

Advantageously, the plug lid includes an flange, a sealed welding line, a first guiding bevel and a guiding hole. The flange engages with the lock slot of the rear cover. The sealed welding line is formed on an internal surface of the plug lid, and the first guiding bevel is formed on the internal surface of the plug lid with one end of the plug lid being inserted into the rear cover. The base correspondingly includes a solder slot engaging with the sealed welding line, a second guiding bevel which forms a guiding opening together with the first guiding bevel and a guiding post engaging with the guiding hole.

Advantageously, the slide groove forms a Z-shaped key thereon, one end of the Z-shaped key serves as a key which is received in a receiving slot formed in the end of the slide groove, and the other end of the Z-shaped key serves as a secure clasp which extends out of the bottom surface of the slide groove towards the plug element. The base forms a block projecting upwardly therefrom and engages with the secure clasp of the rear cover.

Advantageously, the plug lid forms a remaining groove corresponding to the block of the base and the secure clasp of the rear cover.

Advantageously, the Z-shaped key is injection molded together with the rear cover.

In accordance with the present invention, the connecting sheets and the elastic sheets are arranged between the circuit board and the pins, and the connecting sheets are connected to the elastic sheets by inserted connection and are connected to the circuit board by solder. For this type of contact, it is more reliable than the face contact and the point contact. Additionally, it insures a good contact all the time between the circuit board and the pins, thereby prolonging its useful life and overcoming the disadvantage of unreachable elastic sheets after long-term use. This power supply forms a plug lid between the base of the plug element and the rear cover of the plug housing to wholly cover all tabs of an internal circuit in the power supply which contact with an external power supply, thereby removing effectively the danger of getting an electric shock and providing a far safer device to users. Additionally, the present invention adapts to the design of the block engaging with the secure clasp, thereby the plug element is prevented from escaping from the plug housing and ensures stable installation and secure use. The power supply of the present invention has a simple structure and low cost and can be operated conveniently. Additionally, the power supply of the present invention can be applicable to various sockets all over the world.

These and other objects, advantages and novel features of the present invention will become more apparent from the following detailed description when taken in conjunction with the accompanying drawings.

DESCRIPTION OF THE INVENTION

Figure 1:
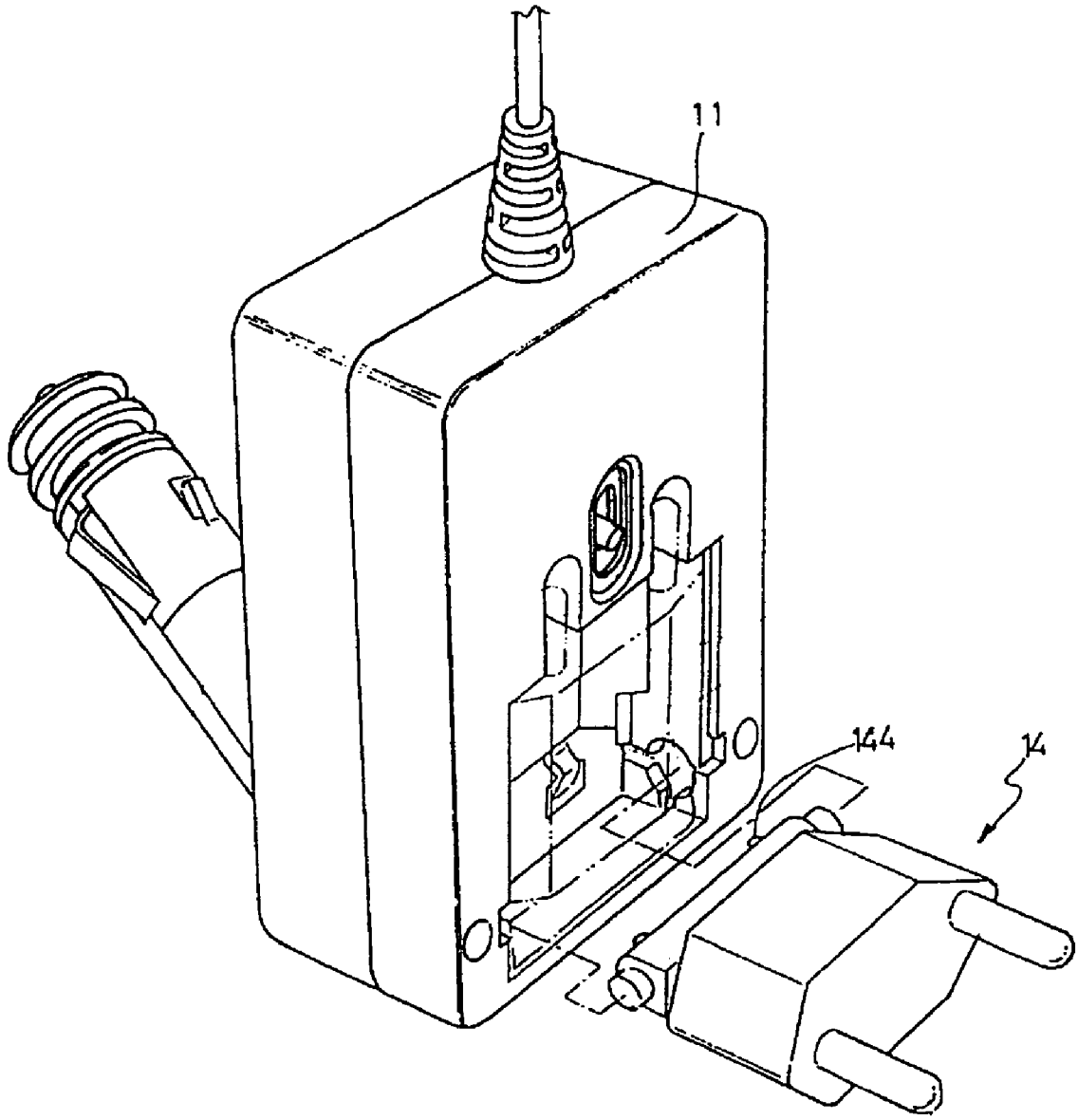
FIG.1 (PRIOR ART)
FIGS. 1–3 (prior art) are perspective views of the prior power supplies in accordance with the prior arts.
Figure 2:
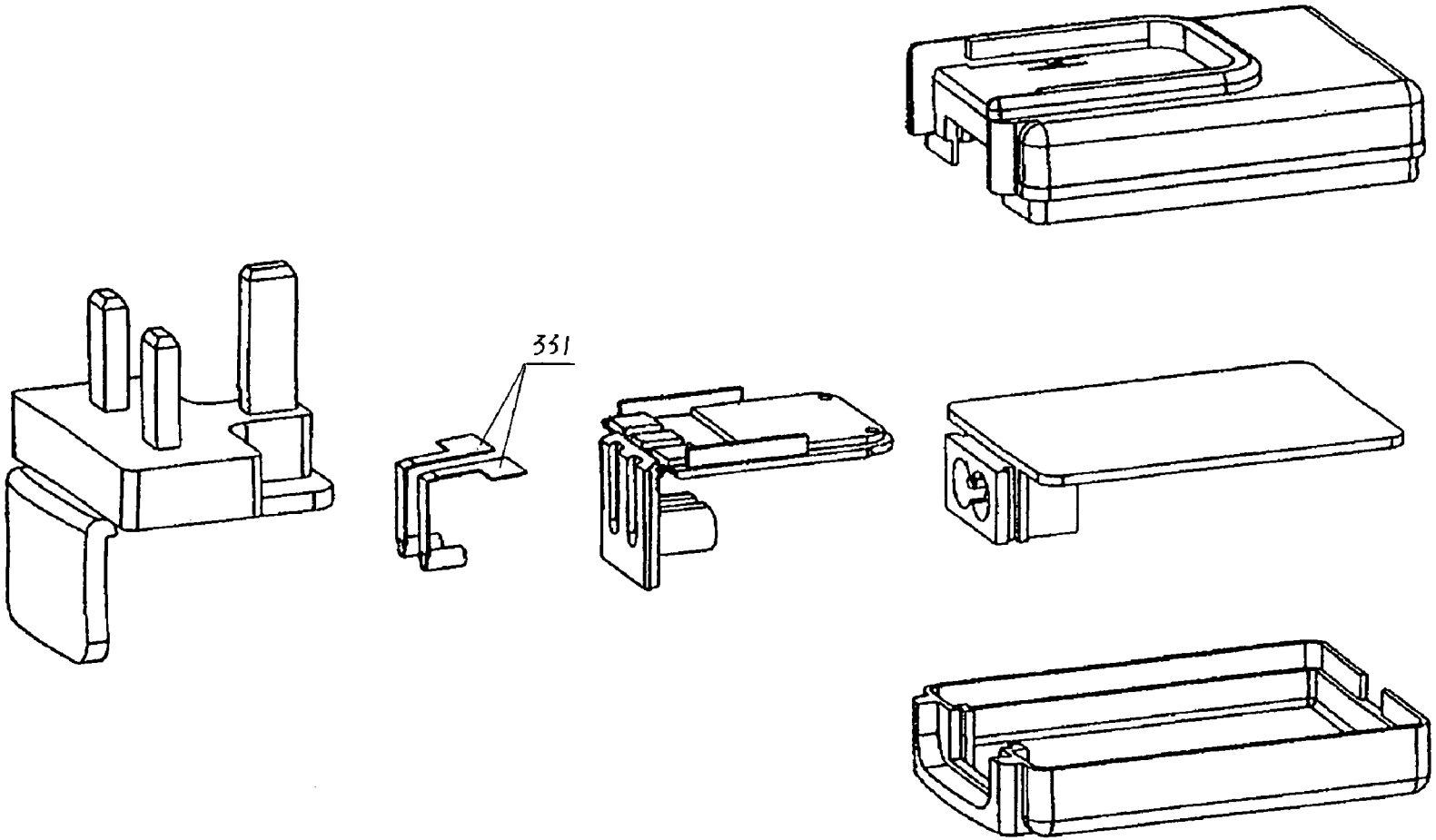
FIG.2 (PRIOR ART)
Figure 3:
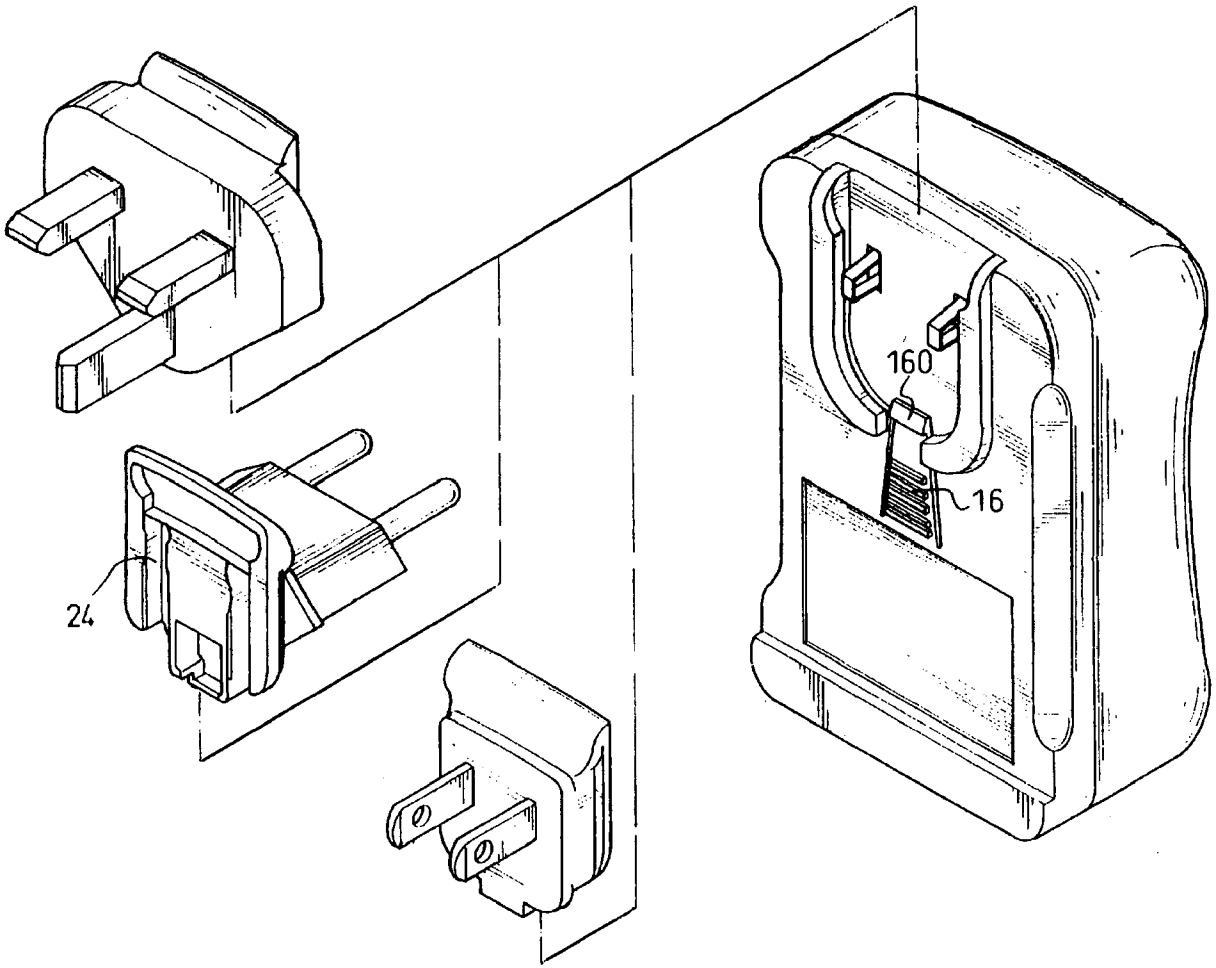
FIG.3 (PRIOR ART)
Figure 4:
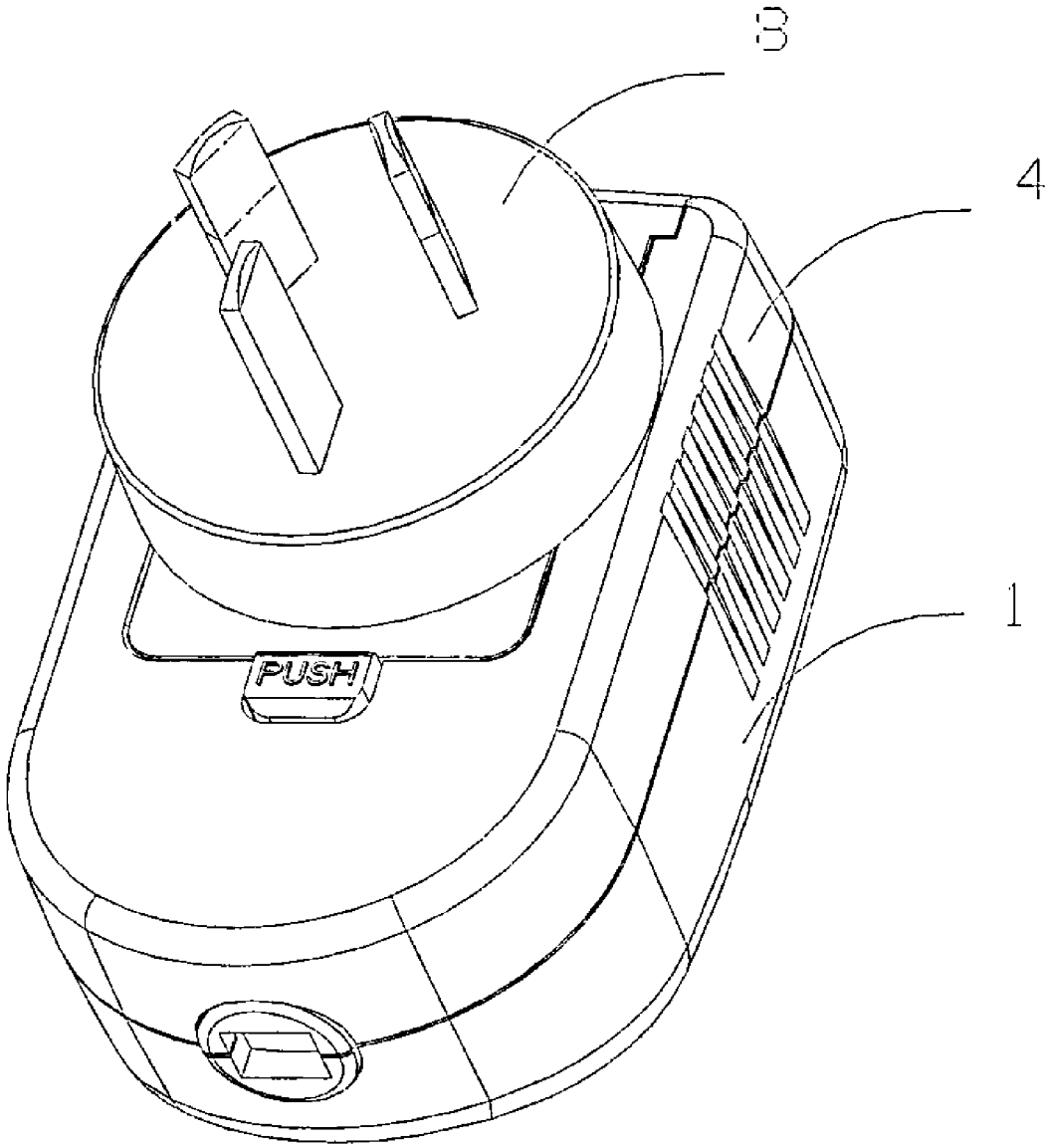
FIG. 4 is a perspective view of a power supply with a changeable plug element in accordance with an embodiment of the present invention.
Figure 5:
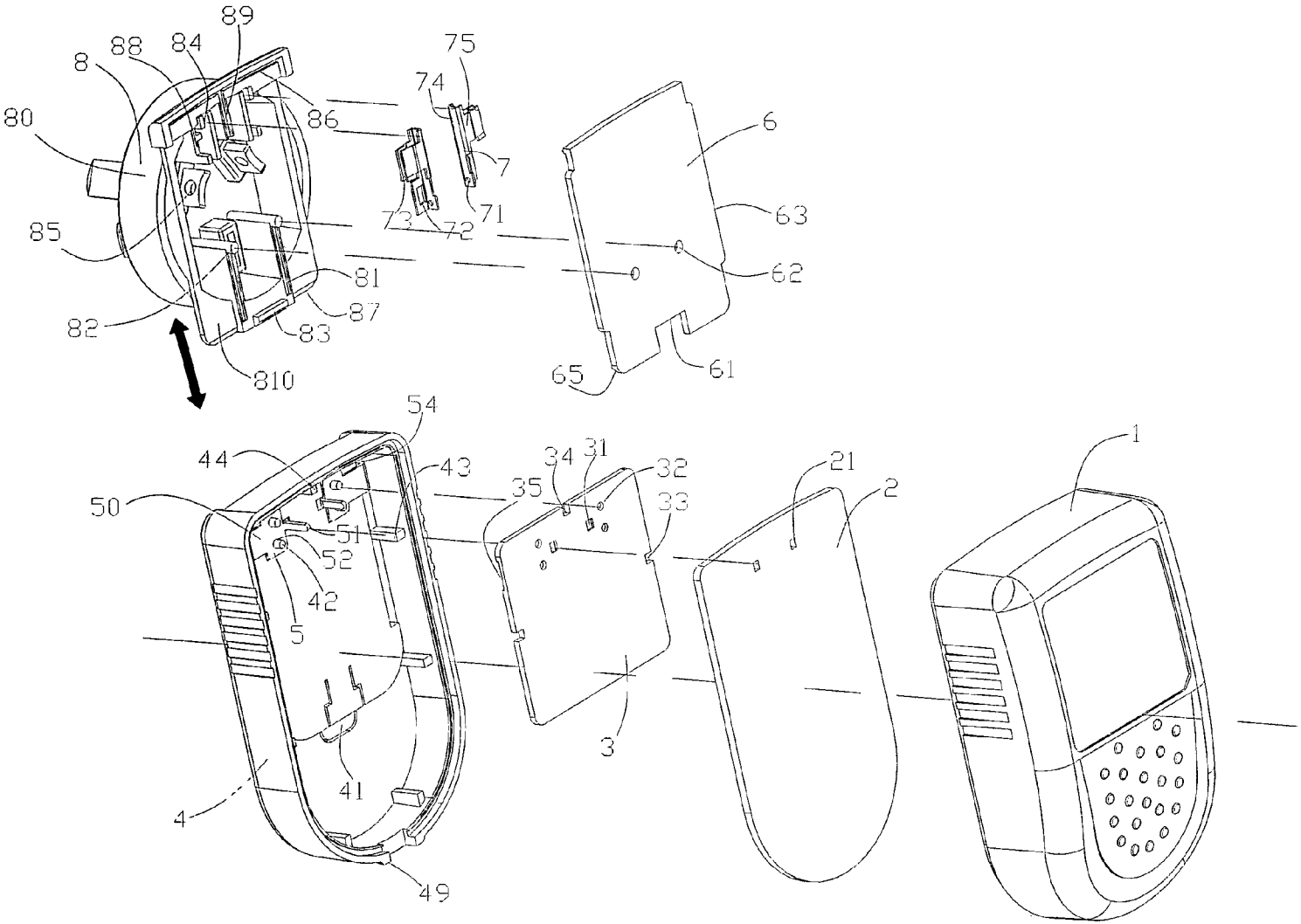
FIG. 5 is an exploded perspective view of a power supply with a changeable plug element in accordance with an embodiment of the present invention.
Figure 6:
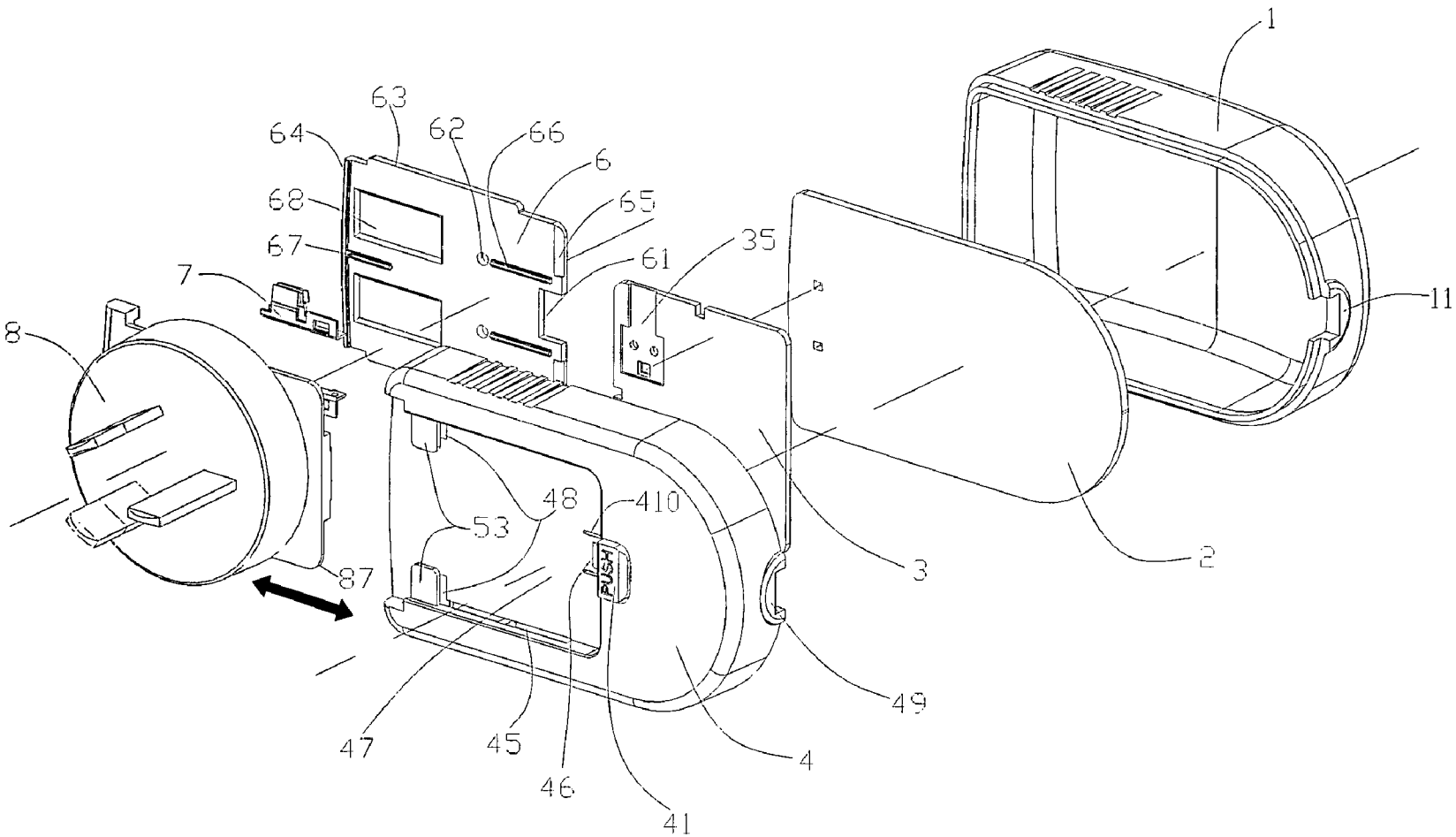
FIG. 6 is an exploded perspective view of a power supply with a changeable plug element seen from another angle in accordance with an embodiment of the present invention.

Referring to FIGS. 4–6, a power supply with a changeable plug element in accordance with an embodiment of the present invention includes a plug housing and a plug element mounted moveably on the plug housing, wherein the plug housing includes a front cover 1, a circuit board 2, a rear cover lid 3, a rear cover 4, and a pair of connecting sheets 5. The plug element includes a plug lid 6, a pair of elastic sheets 7 and a base 8.

The front cover 1 of the plug housing is a hollow cover and forms a first lock location 11 projecting outwardly and having a circular curved surface in one sidewall thereof. The front cover 1 forms a plurality of protrusions on a surface thereof and a plurality of projecting blocks on both external sidewalls thereof for being held easily. The circuit board 2 has a pair of connecting holes 21 therein.

The rear cover lid 3 forms two symmetrical first through holes 31, two pairs of symmetrical second through holes 32, and forms a plurality of guiding slots 33, 34 in the sidewalls. The rear cover lid 3 forms a pair of first accommodating slots 35 in a surface which faces to the rear cover 4.

The rear cover 4 may fasten with the front cover 1 to form a housing for receiving the circuit board 2 and the rear cover lid 3. The rear cover 4 forms two third through holes 48 adjacent to two sides of a bottom surface. Two projecting posts 42 engaging with the second through holes 32 of the rear cover lid 3 are defined on the bottom surface facing the front cover 1. A plurality of posts 43, 44 engaging with the guiding slots 33, 34 of the rear cover lid 3 are defined on internal sidewalls of the rear cover 4. The rear cover 4 also forms a slide groove 47 on the bottom surface facing to the plug element. The slide groove 47 forms a lock slot 45 in each of two symmetrical sidewalls which connect to corresponding third through hole 48, and a receiving slot connecting to the slide groove 47 in the other sidewall. The slide groove 47 forms a Z-shaped key on the end which is injection molded together with the rear cover. One end of the Z-shaped key serves as a key 41 and the other end serves as a secure clasp 46, wherein the key 41 is received in the receiving slot and the secure clasp 46 extends out of the bottom surface of the slide groove 47 towards the plug element. The key 41 has a crevasse 410. This Z-shaped key preferably includes good performance of elastic deformation. In addition, the rear cover 4 forms a second lock location 49 projecting outwardly and includes a circular curved surface in one sidewall, corresponding to the first lock location 11 of the front cover 1 and forms a plurality of projective blocks on both external sidewalls.

Each connecting sheet 5 includes a first body 50 which may be received in corresponding first accommodating slot 35 of the rear cover lid 3. Each first body 50 forms two fourth through holes 52 engaging with the projecting posts 42 of the rear cover 4. Each connecting sheet 5 forms a first bending arm 51 bending perpendicularly from one end of the first body 50 towards the circuit board 2, a second bending arm 54 extending perpendicularly from the other end of the first body 50 towards the reverse direction, and a third bending arm 53 bending from a free end of the second bending arm 54 and being parallel to the first body 50.

The plug lid 6 forms flanges 63 on two symmetrical sidewalls to engage with the lock slots 45 of the rear cover 4 and defines a remaining groove 61 for providing remaining space to the secure clasp 46 of the rear cover 4 when assembled. The plug lid 6 forms sealed welding lines 64, 66, 67 on an internal surface and forms a first guiding bevel 65 on the internal surface. One end of the plug lid 6 is inserted into the rear cover 4. This internal surface forms second accommodating slots 68 for accommodating the elastic sheets 7. The plug lid 6 further includes guiding holes 62.

Each elastic sheet 7 includes a second body 74. The second body 74 extends to one side thereof to form two parallel guiding sheets 75 which form an insert opening 73 for facilitating the insertion of the corresponding connecting sheet 5. The second body 74 also defines a wire connection hole 71 and a positioning hole 72, wherein the positioning hole 72 is adapted to rivet a pin of a tabular socket (such as a pin of U.S. socket, Chinese socket, Japanese socket, etc.).

The base 8 includes a base body 80 and a base surface 810 which projects outwardly from a face where the base body 80 engages with the rear cover 4 and has a shape corresponding to the slide groove 47 of the rear cover 4. The base body 80 defines an accommodating space therein which extends through the base surface 810. The base body 80 arranges three pins (for example, an SAA socket) wherein both symmetrical pins form connection holes 85 to connect with the wire connection holes 71 of the elastic sheets 7 through conducting wires 9. The accommodating space within the base body 80 accommodates projective sheets which form first elastic sheet lock slots 84 and second elastic sheet lock slots 88 to engage with the second bodies 74 and the guiding sheets 75 of the elastic sheets 7 respectively. The accommodating space also accommodates guiding posts 82 projecting upwardly from the base surface 810 to engage with the guiding holes 62 of the plug lid 6. The base surface 810 forms a second guiding bevel 87 at one end thereof which can be inserted into the slide groove 47, corresponding to the first guiding bevel 65 of the plug lid 6. The first and the second guiding bevels 65 and 87 may form a guiding opening for the insertion of the third bending arm 53 of the connecting sheets 5. The base surface 810 forms a block 83 projecting upwardly on the end to clasp with the secure clasp 46 of the rear cover 4. The base 8 also includes solder slots 86, 81, and 89 which may engage with the corresponding sealed welding lines 64, 66, and 67 in the internal surface of the plug lid 6, respectively.

Figure 7:
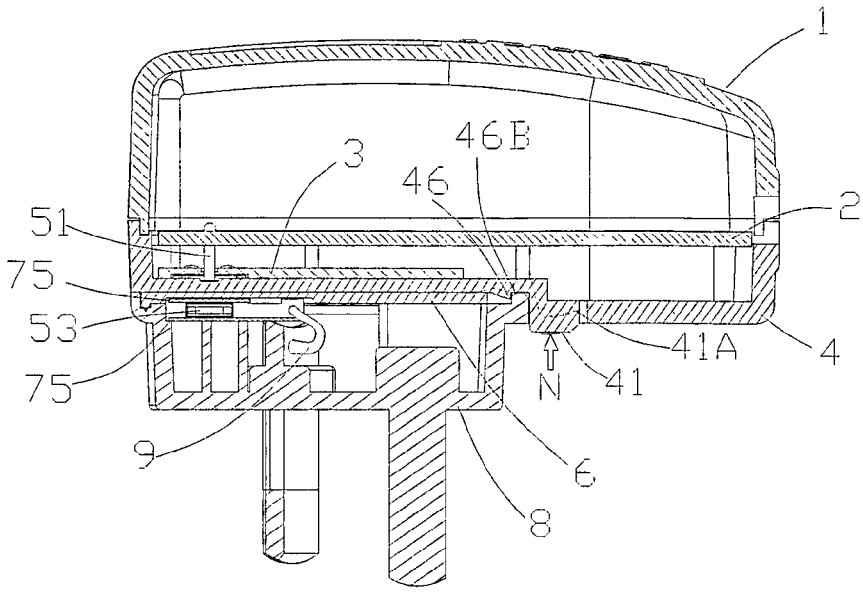
FIG. 7 is a section view of a power supply with a changeable plug element in accordance with an embodiment of the present invention.
Figure 8:
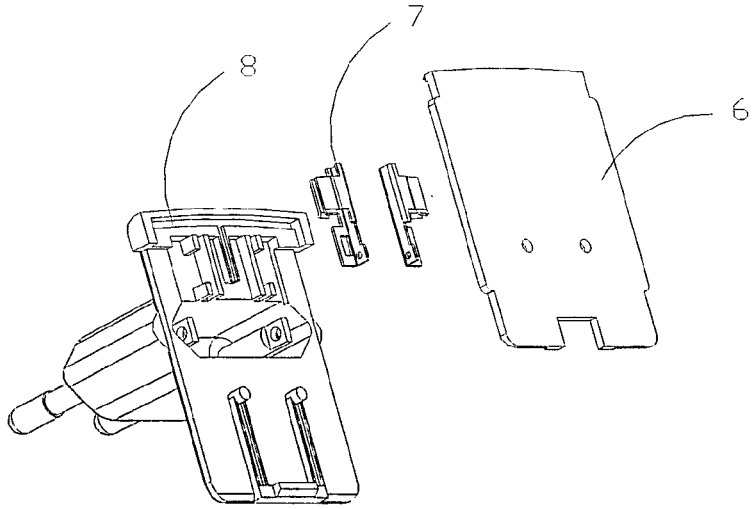
FIG. 8 is an exploded perspective view of a plug element of a power supply with a changeable plug element in accordance with an embodiment of the present invention, corresponding to a VDE socket.
Figure 9:
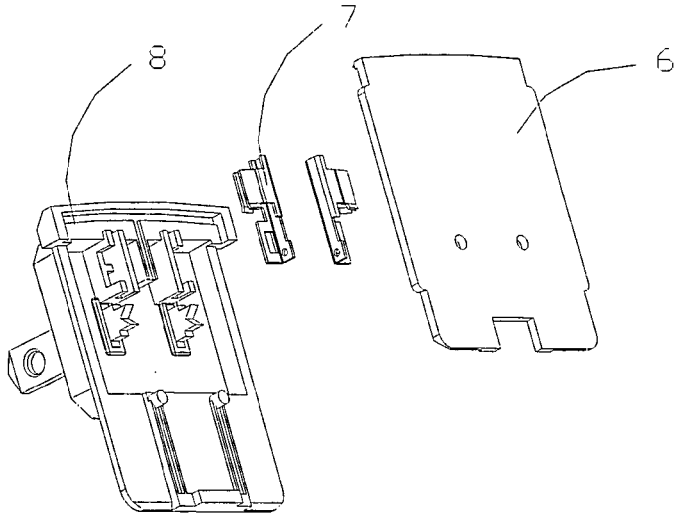
FIG. 9 is an exploded perspective view of a plug element of a power supply with a changeable plug element in accordance with an embodiment of the present invention, corresponding to an UL socket.
Figure 10:
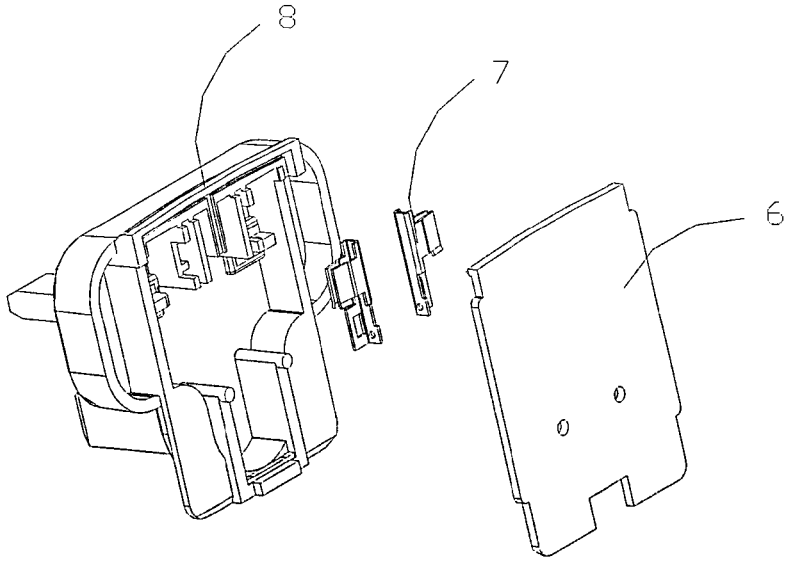
FIG. 10 is an exploded perspective view of a plug element of a power supply with a changeable plug element in accordance with an embodiment of the present invention, corresponding to a BS socket.

FIGS. 4–7 show structure features of the plug element corresponding to SAA socket, in accordance with the embodiment of the present invention. Other structure features of plug elements corresponding to a VDE socket, a UL socket and a BS socket can be adjusted according to variation of base bodies and are shown in FIG. 8, FIG. 9 and FIG. 10 respectively.

To assemble the present invention, the plug housing is installed first. At first, the third bending arms 53 of the two connecting sheets 5 pass through the third through holes 48 of the rear cover 4 to be received in the slide groove 47 of the rear cover 4. The first bending arms 51 face to an inside of the rear cover 4 and the projecting posts 42 of the rear cover 4 pass through the fourth through holes 52 of the first bending arms 51. The third bending arms 53 and the bottom surface of the slide groove 47 form a gap connecting to the lock slot 45. Afterwards, the rear cover lid 3 is mounted on the rear cover to make the guiding slots 33, 34 in the sidewalls of the rear cover lid 3 slide down along the corresponding posts 43, 44 and arrange on the rear cover lid 3, thus making the projecting posts 42 of the rear cover 4 pass through the second through holes 32 in the rear cover lid 3. The rear cover lid 3 is pressed tightly towards the rear cover 4 so that the first bodies 50 of the connecting sheets 5 are received in the first accommodating slots 35 of the rear cover lid 3. The top of the projecting posts 42 is then sealing weld to mount the connecting sheets 5 and the rear cover lid 3 onto the rear cover 4 so as to form a single unit.

The circuit board 2 on the posts 43, 44 are then arranged along the internal sidewalls of the rear cover 4 where the first bending arms 51 can extend through the connecting holes 21 and be soldered with a right surface of the circuit board 2 at the connecting holes 21 so that a current may be conducted. Afterwards, the front cover 1 is fastened to the rear cover 4. The first lock location 11 of the front cover 1 engages with the second lock location 49 of the rear cover 4 to form a lock hole allowing a cable (not shown) to pass through and connect to the circuit board 2. The front cover 1 and the rear cover 4 are sealing weld by ultrasonic for tight engagement therebetween. The assembly of the plug housing is then completed. Because a contiguous portion between any two contiguous surfaces of the front cover 1 and the rear cover 4 is a curved surface, the front cover 1 forms the plurality of protrusions on the surface thereof and both the front cover 1 and the rear cover 4 form the plurality of projective blocks on the corresponding sidewalls. The power supply with a changeable plug element in accordance with the present invention is easy for users to hold and has an aesthetic feeling.

To install the plug element, the connecting holes 85 of the pins are connected with the wire connection holes 71 of the elastic sheets 7 by conducting wires 9. The second bodies 74 and the guiding sheets 75 of the elastic sheets 7 are locked into the first elastic sheet lock slots 84 and the second elastic sheet lock slots 88 on the base 8. The guiding posts 82 are then extended into the guiding holes 62. The solder slots 86, 81, and 89 of the base 8 and the sealed welding lines 64, 66, and 67 are seal welded in the plug lid 6 by ultrasonic means, thereby mounting the plug lid 6 and the elastic sheets 7 onto the base tightly and forming a whole plug element. There is a certain gap between the plug lid 6 and the base surface 810 of the base 8.

The plug element is then inserted into the plug housing. The plug lid 6 of the plug element passes through the gap formed between the third bending arms 53 of the connecting sheets 5 and the bottom surface of the slide groove 47 and is inserted into the plug housing along the lock slots 45, thus allowing the block 83 on the end of the base 8 to engage the secure clasp 46 of the Z-shaped key which extends outwardly from the bottom surface of the rear cover 4. At this time, each of the third bending arms 53 is inserted into the insert opening 73 formed by the two parallel guiding sheets 75 of corresponding elastic sheet 7, so that the connecting sheets 5 are connected through the insertion with the elastic sheets to conduct the current. As a result, the pins are connected to the circuit board 2 to conduct the current.

Thus, the assembly of the power supply with a changeable plug element in accordance with the present invention is disclosed. The assembled power supply is shown in FIG. 7. The plug element and the plug housing wholly covers all the tabs of the internal circuit in the power supply which contact with an external power through the compact engagement between the plug lid 6, the base surface 810 of the base 8 and the slide groove 47 of the rear cover 4. The key 41 of the Z-shaped key is basically on the same horizontal plane as the surface of the rear cover 4, therefore, when changing the plug element it only needs to press the key 41 to position 41A along direction N. Accordingly, the secure clasp 46 connecting with the key 41 moves downwardly to position 46B, thereby detaching the block 83 from the secure clasp 46, thus the whole plug element can be taken off along the slide groove 47.

Generally, in accordance with the present invention, the connecting sheets and the elastic sheets are arranged between the circuit board and the pins, and the connecting sheets are connected to the elastic sheets by connection through insertion and are connected to the circuit board by soldered. For this type of contact, it is more reliable than the face contact and the point contact and provides an outstanding contact all the time between the circuit board and the pins, thereby prolonging its useful life and overcoming the disadvantage of unreachable elastic sheets resulting from long-term use. This power supply forms a plug lid between the base of the plug element and the rear cover of the plug housing to wholly cover all tabs of an internal circuit in the power supply which contact with an external power supply, thereby removing effectively the danger of getting an electric shock and providing safe usage by users. Additionally, the present invention adapts to the design of the block engaging with the secure clasp, thereby the plug element is prevented from escaping from the plug housing and ensures stable installation and secure use. The power supply of the present invention has a simple structure and low cost and can be operated conveniently. Additionally, the power supply of the present invention is applicable for use in various sockets all over the world.

While the present invention has been described with reference to certain embodiments, it will be understood by those skilled in the art that various changes may be made and equivalents may be substituted without departing from the scope of the present invention. In addition, many modifications may be made to adapt a particular situation or material to the teaching of the present invention without departing from its scope. Therefore, it is intended that the present invention not be limited to the particular embodiment disclosed, but that the present invention will include all embodiments falling within the scope of the appended claims.

What is claimed is:

1. A power supply with a changeable plug element comprising:

a plug housing including a front cover, a circuit board, a rear cover and a pair of connecting sheets wherein:

said rear cover and said front cover engaging with each other and contain said circuit board therein;

said rear cover forms a slide groove in a bottom surface thereof;

said slide groove forms a lock slot in a sidewall thereof; and said connecting sheets pass through corresponding third through holes arranged in said bottom surface of the rear cover to be mounted on said rear cover, one end of each of said connecting sheets is soldered on said circuit board and the other end is received in said slide groove, thereby forming a gap between said other ends and a bottom surface of said slide groove; and a plug element mounted moveably on said plug housing and including a base with pins;

a plug lid and a pair of elastic sheet, wherein:

said plug lid is mounted on said base to form a receiving space; and said elastic sheets are received in said receiving space and connected with pin wires, wherein:

said plug lid inserts into said plug housing along said lock slot and passes through said gap between said connecting sheets and said bottom surface of said slide groove to accommodate said other end of each of said connecting sheets received in said slide groove into said receiving space and to connect said other end with corresponding elastic sheet.

2. The power supply with a changeable plug element as claimed in claim 1, wherein each of said elastic sheets forms a wire hole through which each of said elastic sheets connects with corresponding pin wire and a positioning hole through which each of said elastic sheets rivets a pin of a tabular socket.

3. The power supply with a changeable plug element as claimed in claim 1, wherein each of said connecting sheet includes a first body, a first bending arm bending perpendicularly from one end of said first body, a second bending arm extending perpendicularly from the other end of said first body towards a reverse direction, and a third bending arm bending from a free end of said second bending arm and being parallel to said first body, the first bending arm being soldered on said circuit board and the third bending arm connecting with the corresponding elastic sheet.

4. The power supply with a changeable plug element as claimed in claim 1, wherein said plug lid includes a flange, a sealed welding line, a first guiding bevel and a guiding hole, said flange engaging with said lock slot of said rear cover, said sealed welding line being formed on an internal surface of said plug lid, and said first guiding bevel being formed on the internal surface of said plug lid and at one end of said plug lid which is inserted into said rear cover, and said base correspondingly includes a solder slot engaging with said sealed welding line, a second guiding bevel which forms a guiding opening together with said first guiding bevel and a guiding post engaging with said guiding hole.

5. The power supply with a changeable plug element as claimed in claim 1, wherein said plug housing further includes a rear cover lid mounted in said rear cover, said rear cover lid forms a pair of first through holes and a plurality of second through holes, a plurality of projecting posts formed on said rear cover passes through corresponding fourth through holes formed in said connecting sheets to be soldered in corresponding said second through holes of said rear cover lid, and said end of each connecting sheet which is soldered on said circuit board first passes through corresponding said first through hole and then is soldered on said circuit board.

6. The power supply with a changeable plug element as claimed in claim 5, wherein said rear cover lid forms a guiding slot in a sidewall thereof and said rear cover forms a post on an internal sidewall thereof engaging with said guiding slot.

7. The power supply with a changeable plug element as claimed in claim 1, wherein said connecting sheets insertedly connect with corresponding elastic sheets.

8. The power supply with a changeable plug element as claimed in claim 7, wherein each of said elastic sheets includes a second body, two guiding sheets are extended from one side of said second body, which form an insert opening therebetween, and said end of each connecting sheet which is received in said slide groove is inserted into the corresponding insert opening to connect with the corresponding elastic sheet.

9. The power supply with a changeable plug element as claimed in claim 8, wherein said base includes a pair of first elastic sheet lock slots and a pair of second elastic sheet lock slots therein engaging said second bodies and said guiding sheets of said elastic sheets.

10. The power supply with a changeable plug element as claimed in claim 1, wherein said slide groove forms a Z-shaped key thereon, one end of the Z-shaped key serves as a key which is received in a receiving slot formed in the end of said slide groove, the other end of the Z-shaped key serves as a secure clasp which extends out of the bottom surface of said slide groove towards said plug element, and said base forms a block projecting upwardly therefrom and engaging with said secure clasp of said rear cover.

11. The power supply with a changeable plug element as claimed in claim 10, wherein said plug lid forms a remaining groove corresponding to said block of said base and said secure clasp of said rear cover.

12. The power supply with a changeable plug element as claimed in claim 10, wherein said Z-shaped key is injection molded together with said rear cover.

* * * * *